United States Patent [19]

Smith

[11] Patent Number: 4,539,725

[45] Date of Patent: Sep. 10, 1985

[54] APPARATUS FOR CLEANING FURNACE WALLS

[75] Inventor: William R. Smith, Rockdale, Tex.

[73] Assignee: Aluminum Company of America, Pittsburgh, Pa.

[21] Appl. No.: 428,421

[22] Filed: Sep. 29, 1982

[51] Int. Cl.[3] ..... B22D 43/00

[52] U.S. Cl. ..... 15/93 A; 15/56; 15/104.09; 15/104.1 C

[58] Field of Search ..... 15/93 R, 93 A, 56, 104.1 C, 15/104.05, 104.09

[56] References Cited

U.S. PATENT DOCUMENTS

| | | | |
|---|---|---|---|
| 3,471,888 | 10/1969 | Grant et al. | 15/104.07 |
| 3,487,841 | 1/1970 | Goodrum | 134/167 |
| 3,817,348 | 6/1974 | Jones | 15/56 |
| 3,992,745 | 11/1976 | Laurila | 15/56 |
| 3,996,637 | 12/1976 | Shibata et al. | 15/56 |
| 4,110,863 | 9/1978 | Fujimori et al. | 15/104.1 C |
| 4,279,052 | 7/1981 | Evrard et al. | 15/93 A |

*Primary Examiner*—Timothy F. Simone

*Attorney, Agent, or Firm*—Andrew Alexander; John P. Taylor

[57] ABSTRACT

An improved and simplified device for removal of deposits on furnace walls is disclosed which can be operated by a single individual. The device is characterized by rotating scrapers driven by internally-contained air-powered motors. The horizontally opposed scrapers are journalled on each end to pairs of arms which are connected together at a pivot spaced from the journals. Air cylinders, powered from a common source with the air motors, spread the arms apart simultaneously with activation of the air motors to bring the rotating scrapers in contact with the furnace walls.

8 Claims, 5 Drawing Figures

FIG. 3
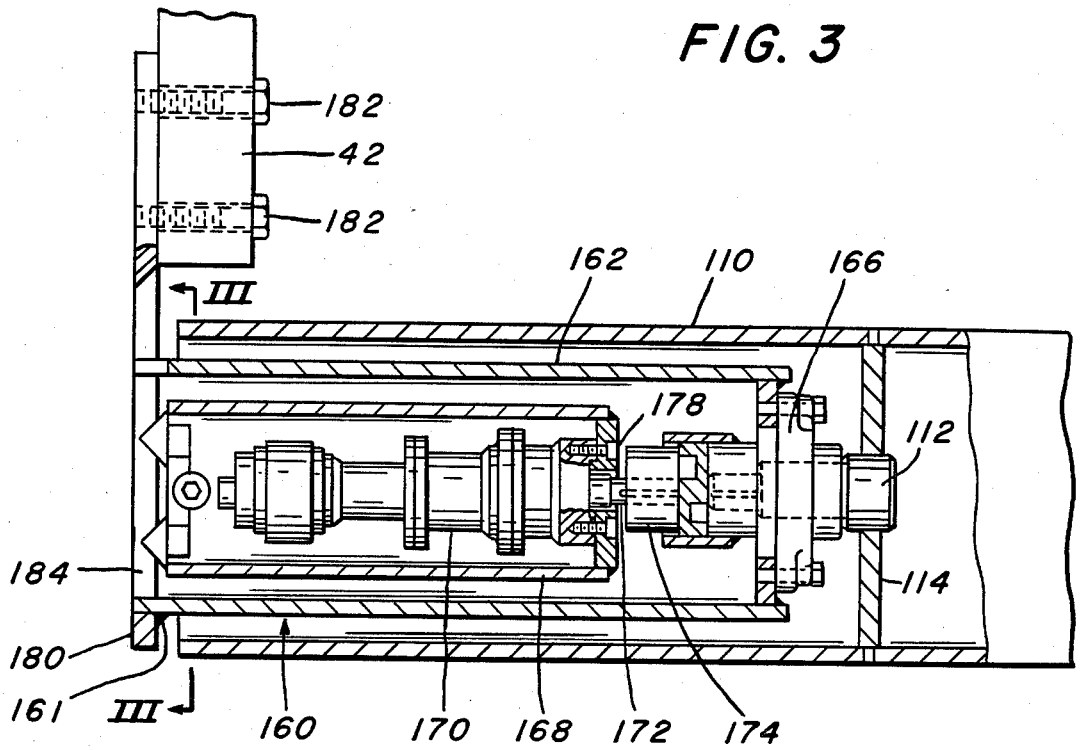
FIG. 4
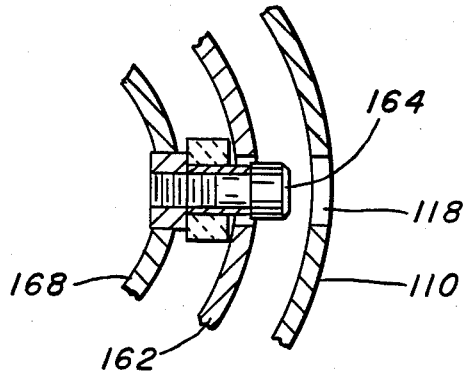
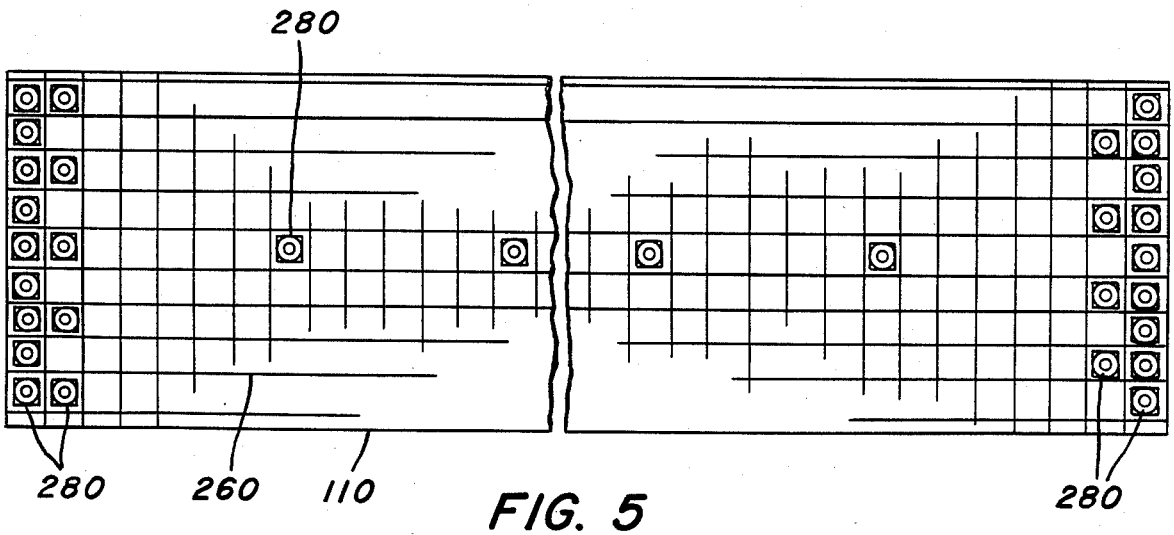
FIG. 5

APPARATUS FOR CLEANING FURNACE WALLS

BACKGROUND OF THE INVENTION

This invention relates to the cleaning of deposits from the walls of a refractory furnace. More particularly, the invention relates to a device containing rotating scrapers to remove deposits from the furnace walls.

Refractory furnaces such as coke, ovens, carbon baking furnaces and the like require periodic cleaning to remove deposits of carbon and other materials on the furnace walls. This can be done manually after first cooling the furnace by a crew of laborers who chip and scrape at the deposits, usually with hand tools. The work is tedious, dirty and, to some extent, a health hazard due to the extreme dust conditions which necessitate the wearing of protective devices such as goggles and masks.

The desire to automate this cleaning operation has lead to the proposing of elaborate devices which attempt to duplicate the manual effort to remove as much of the deposits as possible. Unfortunately, elaborate schemes such as, for example, proposed in Evrard et al, U.S. Pat. No. 4,279,052, can result in the creation of machinery maintenance problems which merely shift the manual labor to the cleaning, maintaining and repairing of equipment. This patent discloses the use of a plurality of chain-driven rotating screw-type cutters against each of two opposing walls of a furnace. The rotating scrapers are linked by a chain to a rotation source and are connected together by universal joints. The use of a plurality of scrapers is said to be necessary in the event that the built-up deposits are thicker on some areas of the walls.

While the described device will apparently permit automation of the cleaning job, the motors, chains and universal joints are all susceptible to maintenance problems because of the carbon deposits generated during the cleaning process. Furthermore, the screw-type scraper blades may have to be periodically replaced as the scraping surface is worn away.

It would, therefore, be desirable to provide a device with a minimum of moving parts exposed to dirt and dust conditions. It would also be desirable to provide a scraping apparatus means not necessitating complete removal for maintenance or renewing of the cutting surface.

SUMMARY OF THE INVENTION

It is, therefore, an object of the invention to provide a simplified cleaning apparatus for cleaning deposits from furnace walls.

It is another object of the invention to provide self-contained rotational means on the cleaning apparatus for removing deposits from furnace walls with a minimum exposure of the rotational driving means to the resultant dust and dirt attendant with the removal.

It is yet another object of the invention to provide simplified means for renewing the cutting surfaces of the rotational means without removal of the rotational means.

It is a further object of the invention to provide a device for cleanihg and removing deposits from furnace walls which provide a single control for rotating a deposit removal means against the furnace walls and for urging the removal means against the furnace wall.

These and other objects of the invention will be apparent from the accompanying description and drawings.

BRIEF DESCRIPTION OF THE DRAWINGS

FIG. 3 is a further cutaway view of FIG. 2 showing inside the inner and outer motor casing.

FIG. 4 is a cutaway end section of FIG. 3 taken along lines III—III.

FIG. 5 is a side view of a portion of the outer surface of the drum.

DETAILED DESCRIPTION OF THE PREFERRED EMBODIMENTS

Figure 1:
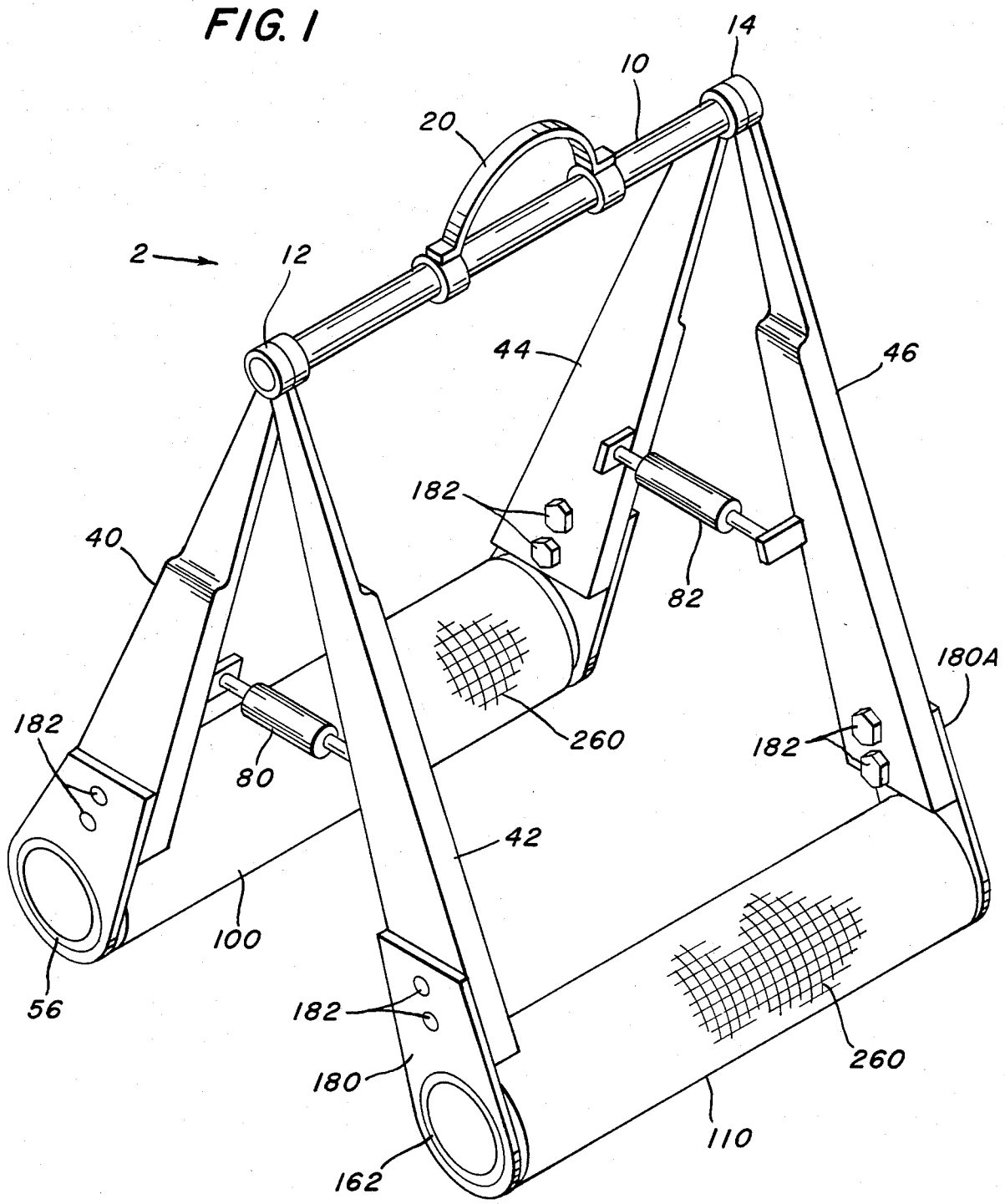
FIG. 1 is an isometric view of the apparatus.

Turning now to FIG. 1, the furnace cleaning apparatus, generally indicated at 2, comprises a bar 10 having a handle 20 thereon which can be grasped by the hook of an overhead crane and two rotatable cleaning drums 100 and 110 which are mounted to bar 10 via arms 40–46 which depend therefrom.

Arms 40 and 42 are pivotally mounted at 12 to one end of bar 10. Arms 44 and 46 are pivotally mounted at 14 to the opposite end of bar 10.

Figure 2:
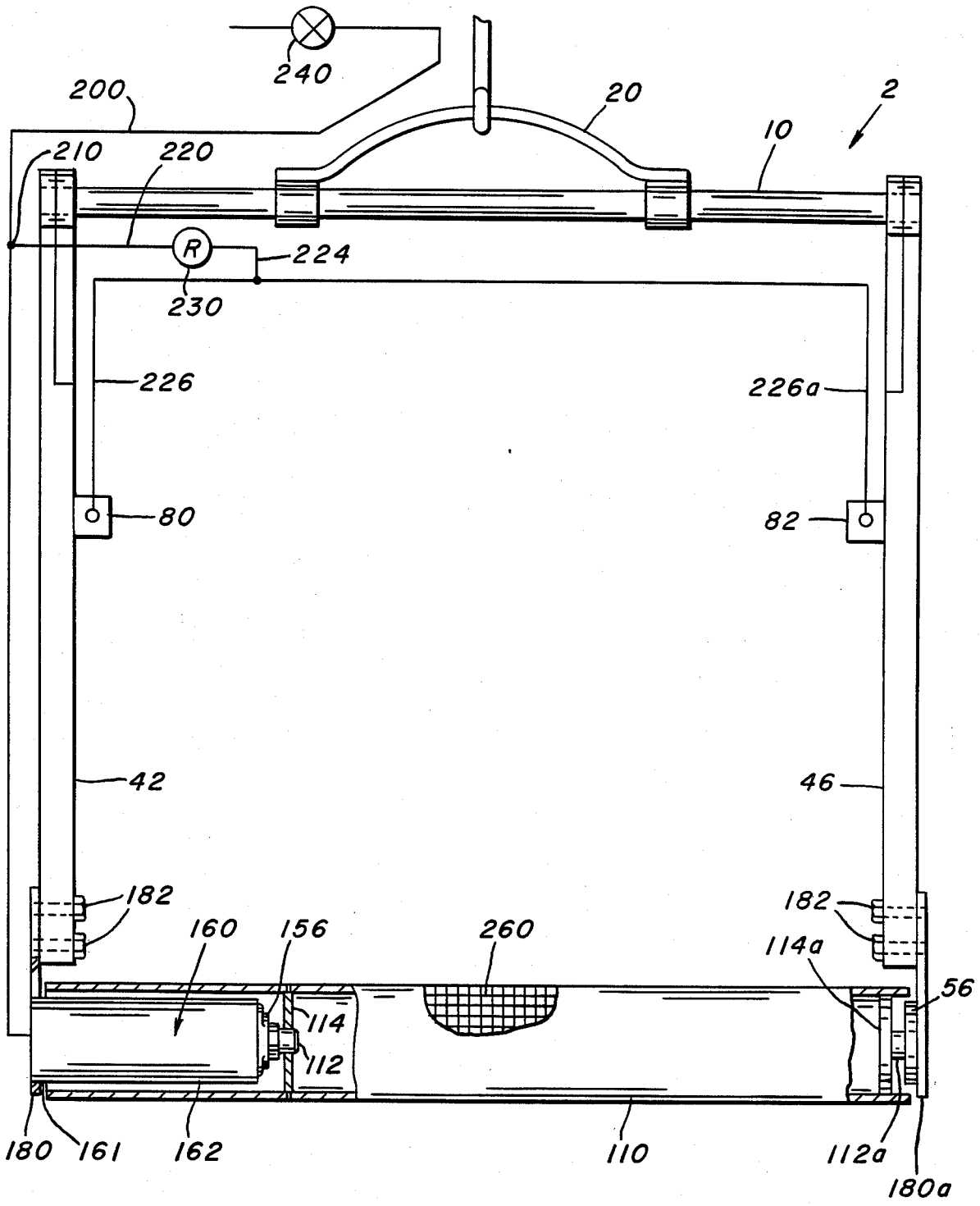
FIG. 2 is a partially sectioned side view of the apparatus.

As seen more clearly in FIG. 2, drum 110 is rotatably mounted to arms 42 and 46. The attachment of drum 110 to arm 46 is via a bearing 56 on arm 46 through which a shaft extension **112*a* on drum 110 is journalled, as will be described below. Drum 110 is carried by arm 42 via air-driven motor assembly 160. Drum 110 comprises a hollow cylinder having an inner diameter slightly smaller than the outer diameter of outer shell 162 of air motor 160. A round plate or spider 114 is mounted within drum 110, preferably in a removable manner as by set screws passing through drum 110 into plate or spider 114. Shaft 112 is centrally welded to spider 114 coaxially with drum 110**.

Shaft 112 passes through a bearing 156 mounted to the outer shell 162 of air motor assembly 160. Shaft 112 is coupled to air motor 160 via a spline arrangement, as will be described below.

Outer casing 162 of air motor assembly 160 is, in turn, secured at 161, as by welding or the like, to a mounting plate 180 which is bolted to arm 42 by bolts 182.

Spider **114*a*, having shaft 112*a* coaxially secured thereto, is mounted inside the opposite end of drum 110 in similar fashion except that it may be mounted closer to the end of drum 110. Shaft 112*a* passes through bearing 56 which is mounted as by welding to plate 180*a*, which is secured by bolts 182 to arm 46**.

Turning now to the cutaway view of motor assembly 160 shown in FIG. 3, air motor 170 is mounted to an inner casing 168 by bolts 178. Motor shaft 172 is coupled to shaft 112 by spline assembly 174 which permits easy disengagement of motor 170 should removal of motor 170 be desired.

As best seen in FIG. 1, inner casing 168 is secured to outer casing 162 by set screws 164, which may be accessed through openings 118 provided in drum 110. Two set screws are used in the illustrated embodiment spaced 180° apart.

Motor 170 and inner casing 162 may be removed from the apparatus as a unit after removal of set screws 164 via an opening 184 provided in plate 180. Opening 184 also provides ingress for air line 200 which provides compressed air to air motor 170. Air line 200 is routed along arm 42 to bar 10 where it joins a second air line (not shown) which feeds a similar motor powering drum 100. The construction and interrelationship of arms 40 and 44 with drum 100 is the same as that already described for arms 42 and 46 and drum 110. The use of a single supply of air (and at the same pressure) for the identical air motor respectively powering drums 100 and 110 insures that both will rotate at the same speed as the apparatus is raised or lowered by the crane operator.

It should also be noted here that the mounting of air motor assembly 160 within drum 110 shields the air motor assembly from the dust and particles abraded from the furnace walls which might otherwise clog the moving parts, thus requiring more maintenance and downtime. In fact, the egress of the air through the end of drum 110 will actually tend to purge the motor area of dirt particles.

Air line 200, in addition to junctioning with a similar air line for the motor powering drum 100, junctions at 210 with an air line 220, which passes through an air regulator 230 to reduce its pressure. The amount of pressure reduction is preselected to permit sufficient urging of the drums against the furnace walls without stalling the air motors by excessive force against the furnace walls. Air line 224 from air regulator 230 branches into lines 226 and **226*a*, which respectively feed air cylinders 80 and 82**.

After the crane operator has lowered furnace cleaning apparatus 2 into a furnace, air line 200 is activated by solenoid 240 in the crane which feeds air pressure from the crane into air line 200. Air feeding from line 200 through regulator 230, line 226 and line **226*a* to air cylinders 80 and 82 urge the opposing arms 40,42 and 44,46 apart to bring drums 100 and 110 into contact with the furnace walls. At the same time, air line 200 feeds air into air motor 170 and its counterpart in drum 110 to rotate both drums. It should be noted in this regard that the air motor in drum 100 is mounted in the opposite end from the mounting of air motor 170 in drum 110** to impart counter rotation by the two drums which permits even travel of the apparatus up and down the furnace walls.

Thus, a single source of air activated by a single switch by the crane operator simultaneously operates all the air cylinders and air motors on the apparatus obviating any need for additional manual operations conducted by personnel within or adjacent to the furnace, as in the prior art, as illustrated, for example, in the aforementioned Evrard et al patent.

Drums 100 and 110 are provided with a renewable cutting surface by mounting a flat wire belt 260 to the surface of the drum. In the preferred embodiment, belt 260 is a 1"×1" flat wire belt, picket size $\frac{3}{8}$"×0.046 flat high carbon steel with 11 gauge (0.120) connector pins.

Belt 260 is rotationally secured to drum 110 by a series of $\frac{3}{8}$" nuts 280 which are positioned circumferentially around drum 110. As best seen in FIG. 5, in a preferred embodiment, a series of nuts is radially positioned around drum 110 to fit into every opening adjacent the end of the drum and every other opening in the next set of pickets. As shown in the drawing, three nuts are then spaced 120° apart in every sixth row of pickets to the other end of drum 110 where the arrangement at the first end is repeated. The belt is then cut to fit the circumference of drum 110, and the ends of the belt are crimped or welded together at the seam. Should the belt wear down or break, it thus is easily removed from the drum and a new belt put in place. The seam merely holds the belt together while the cog wheel action of the nuts in the belt openings serve to secure the belt rotationally to the drum. This type of cutting surface thus provides many scraping edges which reduce the point contact pressure, which provides longer life for the cutting edges as well as lowering refractory damage to the walls of the furnace.

Thus, there is provided an apparatus for cleaning furnaces which is simple to operate by one man, requires little maintenance due to the location of the driving parts within the rollers where they are shielded from the dust which will be produced by the operation, and which uses a single supply of air with a single control operating all air tools. The apparatus of the invention is further characterized by an easily renewable cutting surface which also contributes to lower maintenance and downtime.

Having thus described the invention, what is claimed is:

1. Apparatus for removing deposits on walls of refractory furnaces comprising:

(a) rotating drums having self-contained air-powered rotation means therein for simultaneous engagment of opposite walls, each of said rotating drums having a first end and an opposite second end;

(b) a plurality of support arms each having a first end, a pivot point at an opposite end and an intermediate point;

(c) journal means connecting said first end of each of said support arms respectively to one of said ends of said drums;

(d) means for pivotally joining together at their pivot points two arms respectively mounted to first ends of two drums; and (e) spacing means positioned at the intermediate points of said pivotally joined together arms comprising an air cylinder commonly powered with said air powered rotation means to permit simultaneous rotation of said drums and urging of drums against said walls with a single control means.

2. The apparatus of claim 1 wherein said air-powered rotational means comprise air motors mouted to said arms and positioned wholly within said drums to protect said motors from dust and dirt generated by the removal of said deposits.

3. The apparatus of claim 2 wherein said common powering of said air motors and said air cylinders is accomplished by preselecting a reduced pressure for said air cylinders by a pressure regulator so that the pressure urging said rotating drums against the furnace walls is not sufficient to stall the motors.

4. The apparatus of claim 3 wherein a renewable cutting surface is removably mounted to the surface of said drums.

5. The apparatus of claim 4 wherein said renewable cutting surface comprises a wire mesh belt.

6. The apparatus of claim 5 wherein lugs mounted to said drum fit into openings in said belt to rotationally secure said belt to said drum.

7. The apparatus of claim 6 wherein said wire mesh belt comprises a flat wire belt.

8. An apparatus for removing deposits on walls of refractory furnaces comprising:

(a) at least two rotating drums having self-contained air-powered air motors therein for simultaneous engagement of opposite walls, each of said drums having a first end and an opposite second end;

(b) a renewable cutting surface comprising a flat wire belt removably mounted to the surface of said drum by lugs mounted to said drum which fit into openings in said belt to rotationally secure said belt to said drum;

(c) a plurality of support arms each having a first end attached to an end of each of said drums, each of said support arms having an opposite end thereof and an intermediate point;

(d) means for pivotally attaching together said opposite ends of said support arms attached to said first ends of said drums and for pivotally attaching together said opposite ends of said support arms attached to the second ends of said drums; and (e) spacing means comprising air cylinders means having a first end mounted at said intermediate point of one said support arms and a second, opposite end mount to the intermediate point of the support arm pivotally joined to the support arm connected to the first end of said cylinder means, said air cylinder means being commonly powered with said air motors to permit simultaneous rotation of said drums via said air motors while urging said drums into contact with the walls of said furnace.

* * * * *